US006364474B1

(12) United States Patent
Chang et al.

(10) Patent No.: US 6,364,474 B1
(45) Date of Patent: Apr. 2, 2002

(54) PRESSURE CONTROL DEVICE

(75) Inventors: Charles C. Chang; Chieh-Wen Wang; I-Chung Hou, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/465,906

(22) Filed: Dec. 17, 1999

(30) Foreign Application Priority Data

Sep. 10, 1999 (TW) ..... 88115623

(51) Int. Cl.[7] ..... B41J 2/175
(52) U.S. Cl. ..... 347/86
(58) Field of Search ..... 347/87, 86, 85

(56) References Cited

U.S. PATENT DOCUMENTS 4,509,062 A * 4/1985 Low et al. ..... 347/87
5,280,300 A * 1/1994 Fong et al. ..... 347/87
5,691,755 A * 11/1997 Pawlowski, Jr. et al. ..... 347/86
5,880,764 A * 3/1999 Barinaga ..... 347/86
6,227,662 B1 * 5/2001 Takata ..... 347/86

FOREIGN PATENT DOCUMENTS

WO WO-90/00975 * 2/1990 ..... 347/86

* cited by examiner

*Primary Examiner*—David F. Yockey
(74) *Attorney, Agent, or Firm*—J. C. Patents

(57) ABSTRACT

A pressure control device for regulating the ink pressure of a multi-reservoir ink cartridge. The pressure regulator employs an external spring or springs plate assembly mounted between two neighboring ink reservoirs. The external surfaces of the spring or assembly are attached to the respective side face of the reservoirs. Each ink reservoir has at least a side face formed from a flexible non-elastic material. When all of the ink reservoirs are full, the spring or assembly is in a relaxed state. By withdrawing a small quantity of ink from each ink reservoir, atmospheric pressure exerts forces on the ink reservoirs leading to a small contraction. The resulting distortion of the spring or assembly produces a force that resists further contraction of the reservoirs. Since the pressures inside the reservoirs are smaller than external atmospheric pressure, a back-pressure that prevents any leakage of ink from the reservoirs is created. In addition, a pressure plate can be added to the spring means to squeeze the ink out of the reservoir more evenly.

28 Claims, 5 Drawing Sheets

PRESSURE CONTROL DEVICE

CROSS-REFERENCE TO RELATED APPLICATION

This application claims the priority benefit of Taiwan application serial no. 88115623, filed Sep. 10, 1999.

BACKGROUND OF THE INVENTION

1. Field of Invention

The present invention relates to a pressure control device. More particularly, the present invention relates to a pressure control device for controlling the flow of ink from the ink reservoir of an ink cartridge.

2. Description of Related Art

Most conventional inkjet printers employ a jet nozzle to deliver ink to paper. The ink required by the print head is usually supplied from an ink reservoir within an ink cartridge. To direct the ink from the reservoir to the print head so that printing can be carried out smoothly, the How of ink must be regulated. Although regulating the flow of ink can guarantee a spray of fine ink drops, some mechanism must be present to prevent ink from leaking from the cartridge when the print head is not printing.

To prevent ink leakage, two self-adjusting mechanisms have been developed so far. The first method is the placement of some polymer foam inside the ink reservoir. Utilizing the capillary action of narrow spacing within the foam, leakage is prevented. However, storage capacity for this kind of ink reservoir is rather limited. The second method is to set up a sub-atmospheric or negative pressure inside the ink reservoir when the print head is not in use. A negative pressure is created when the ink reservoir is in a partial vacuum so that its internal pressure is lower than external atmospheric pressure. Hence, an increase in negative pressure means that the degree of vacuum inside the reservoir is increased. By setting up a negative pressure inside the ink reservoir, seepage of ink from the print head virtually stops.

Although the presence of a negative pressure inside the ink reservoir may suppress ink leakage from the print head, too much negative pressure will also prevent ink drops from getting out of the print head during printing. Moreover, if the external pressure changes, the negative pressure inside the reservoir needs to be changed correspondingly. For example, if there is a drop in the external pressure, the negative pressure must drop correspondingly in order to prevent the leakage of ink from the print head.

In 1980, Epson developed a type of ink reservoir described in U.S. Pat. No. 4,422,084. The invention uses organic polypropylene to form the ink reservoir. Negative pressure inside the ink reservoir is regulated by a set of springs both inside and/or outside the reservoir. However, using this type of pressure control mechanism, a portion of the ink inside the reservoir cannot be used. Furthermore, the ink reservoir is detached from the cartridge of the print head.

In 1982, Hewlett Packard has developed a type of ink reservoir for print heads described in U.S. Pat. No. 4,509.062. The invention relies on non-linear springs and a rubber bladder for maintaining a negative pressure inside the ink reservoir. One end of the spring is fixed upon a supporting structure while the other end is attached to the rubber bladder. However, due to the springs and other support structures, the volume of ink held by each reservoir in a multi-reservoir ink cartridge, for color printing especially, is severely limited.

In 1992, Hewlett Packard has developed another type of ink reservoir described in U.S. Pat. No. 5,757.706. A spring formed by a pair of thin plates is placed inside the ink reservoir. Through the forces exerted by the spring plates on two non-elastic soft walls of the reservoir, a suitable negative pressure is created. However, since the spring plates are enclosed inside the ink reservoir, the spring plates are likely to react chemically with the ink.

SUMMARY OF THE INVENTION

Accordingly, one object of the present invention is to provide a pressure control device for controlling the flow of ink from a print head cartridge. A negative pressure of suitable magnitude is formed inside the ink reservoirs where the ink is stored. Therefore, ink drops can exit the reservoir during a normal printing operation and cannot leak out from the reservoir when the printing stops. Furthermore, because the pressure control device enables the ink reservoirs to be fully compressed, even the last few drops of ink inside the ink reservoir can be used.

To achieve these and other advantages and in accordance with the purpose of the invention, as embodied and broadly described herein, the invention provides a pressure control device suitable for a multi-reservoir ink cartridge. The pressure control device employs an external traction spring means between the ink reservoirs of the cartridge. Each ink reservoir has at least a side surface formed from a flexible non-elastic material. When the ink reservoirs are full, the traction spring means is in a relaxed state. By withdrawing a small quantity of ink from each ink reservoir, atmospheric pressure exerts a force on the ink reservoirs leading to a small contraction. The resulting distortion of the traction spring means produces a force that resists further contraction of the reservoirs. Since the pressures inside the reservoirs are smaller than external atmospheric pressure, a back-pressure that prevents any ink from leaking out of the reservoirs is created. Through proper design of the traction spring means loading and elasticity of the ink reservoirs, a suitable ink jet is formed during normal printing operation. In addition, a pressure plate can be added to the traction spring means to squeeze ink from the reservoir more evenly. Hence, the back-pressure of each ink reservoir can be more effectively controlled and every drop of ink inside each ink reservoir can be fully utilized.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
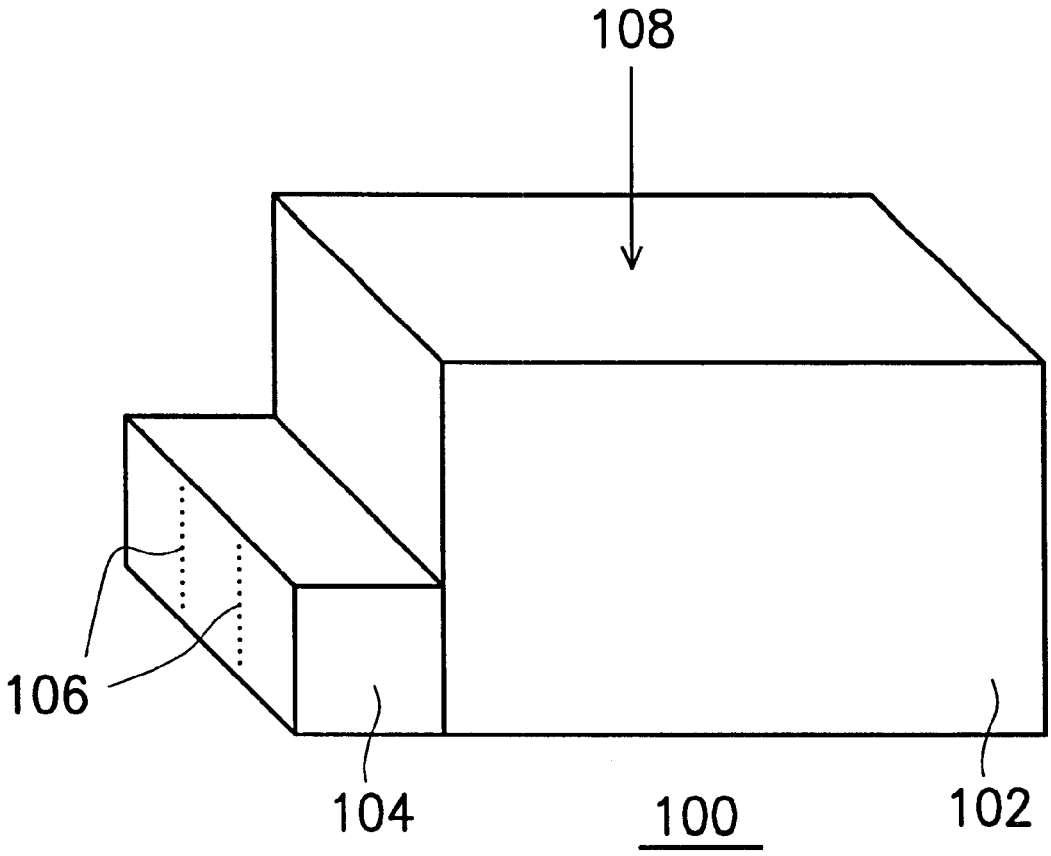
FIG. 1 (PRIOR ART)
FIG. 1 is a sketch showing the cartridge of a conventional inkjet print head.

Reference will now be made in detail to the present preferred embodiments of the invention examples of which are illustrated in the accompanying drawings. Wherever possible, the same reference numbers are used in the drawings and the description to refer to the same or like parts.

FIG. 1 is a sketch showing the cartridge of a conventional inkjet print head. As shown in FIG. 1, the ink cartridge 100 can be divided into two major sections: a cartridge body 102 and a cartridge nose 104. Ink for printing is stored inside the cartridge body 102. The cartridge nose 104, on the other hand, includes filters, ink channels (not shown in the figure) and banks of jet nozzles 106. Since the cartridge nose 104 only occupies a small volume, back-pressure regulation has to be conducted inside the cartridge body 102.

Figure 2A:
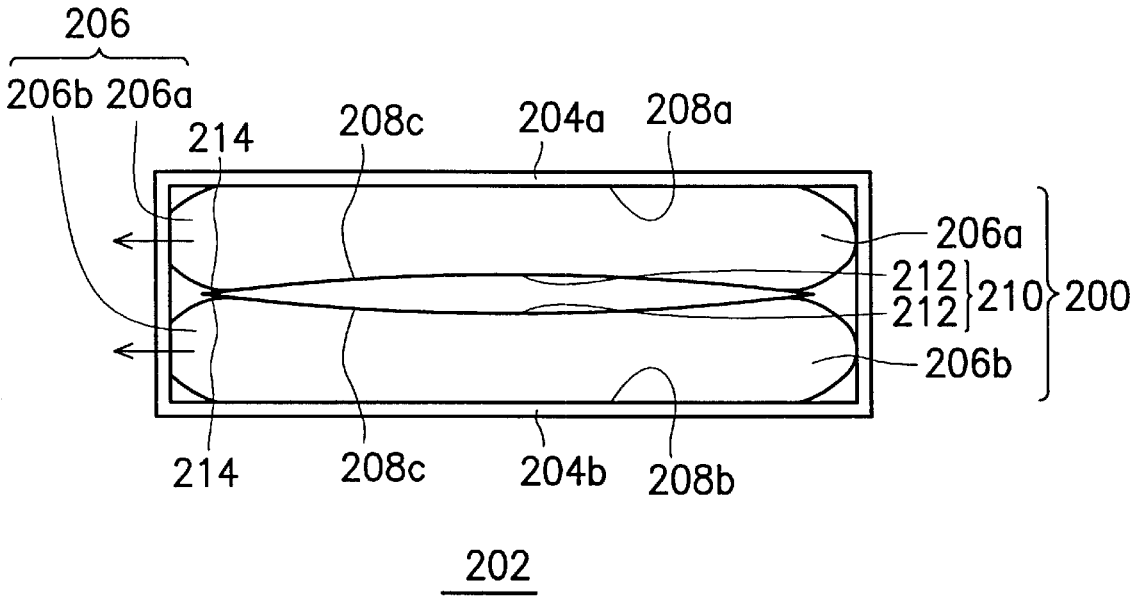
FIG. 2A is a schematic cross-sectional view showing the pressure control device inside an inkjet cartridge according to a first embodiment of this invention when the ink reservoirs are full.
Figure 2B:
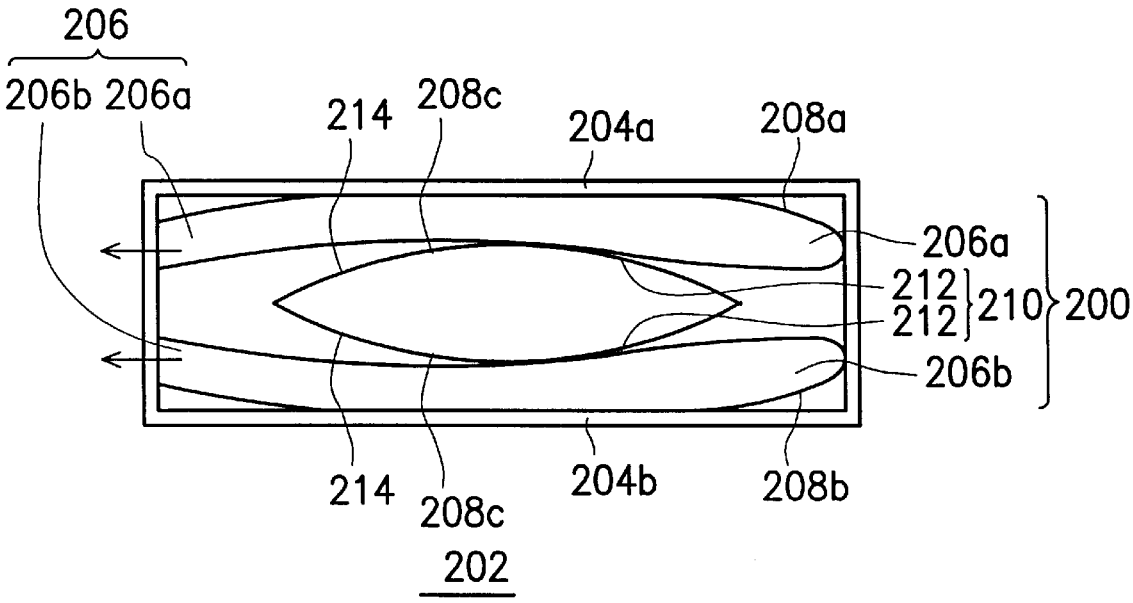
FIG. 2B is a schematic cross-sectional view showing the pressure control device inside an inkjet cartridge according to the first embodiment of this invention when the ink reservoirs are rather empty.

The pressure control device of this invention is installed inside an ink cartridge similar to the one shown in FIG. 1. FIG. 2A is a schematic cross-sectional view showing the pressure control device inside an inkjet cartridge according to a first embodiment of this invention when the ink reservoirs are full. FIG. 2B is a schematic cross-sectional view showing the pressure control device inside an inkjet cartridge according to the first embodiment of this invention when the ink reservoirs are rather empty. In fact, FIGS. 2A and 2B are cross-sectional views of a cartridge body, very similar to the cartridge body 102, along a plane perpendicular to the viewing direction 108 in FIG. 1.

As shown in FIG. 2A. the pressure regulator 200 includes traction spring means 210 and ink reservoirs 206. The ink cartridge body 202 has a first sidewall 204*a* and a second sidewall 204*b* that are parallel to each other. The cartridge body 202 also has a plurality of reservoirs 206 running parallel to the first sidewall 204*a* and the second sidewall 204*b*. Each ink reservoir 206 includes at least a side face 208*c* formed from a flexible non-elastic material. The flexible non-elastic material includes aluminum foil and plastic sheeting. The first ink reservoir 206*a* is attached to the first sidewall 204*a*while the second ink reservoir 206*b* is attached to the second sidewall 204*b*.

A first side face 208*a* of the first ink reservoir 206*a* is attached to the first sidewall 204*a*. Similarly, a second side face 208*b* of the second ink reservoir 206*b* is attached to the second sidewall 204*b*. The traction spring means 210 is inserted between the ink reservoirs 206*a* and 206*b*. The sides of the traction spring means 210 are attached to the central portion of the side faces 208*c* of the ink reservoirs 206*a* and 206*b*, respectively. The traction spring means 210 comprises of two spring, plates 212 running almost parallel to the first sidewall 204*a* and the second sidewall 204*b* between two ink reservoirs 206*a* and 206*b*. The front ends and the back ends of the spring, plates 212 are bonded together to form a spring, plate assembly. Material for forming the spring plates 212 includes metal, plastic, bamboo or wooden sheet. The exterior surfaces 214 of the assembled spring plates 212 are attached to the side face 208*c* of the first reservoir 206*a* and the second reservoir 206*b*, respectively.

As shown in FIGS. 2A and 2B, the arrows show the direction towards which ink flows from the reservoirs 206*a* and 206*b* to the cartridge nose section (label 104 in FIG. 1). Ultimately, ink will be ejected through ink nozzles (label 106 in FIG. 1) during a printing operation.

When the reservoirs 206*a* and 206*b* of the cartridge body 202 are full of ink as shown in FIG. 2A, the spring plates 212 of the traction spring means 210 are in the most relaxed position. Since the ink reservoirs 206 are completely sealed, the ink reservoirs 206 shrink a little due to atmospheric pressure after a small amount of ink is removed. Hence, the spring plates 212 mounted next to the reservoirs 206 will deform slightly. A restorative or traction force resisting the shrinking of the reservoirs 206 results from the deformation of the spring plates 212. Consequently, a negative pressure is created so that the pressure inside the reservoirs 206 is smaller than external atmospheric pressure. The negative pressure inside the reservoirs 206 prevents the ink from leaking out of the reservoirs 206 after printing stops.

After the cartridge has been in use for some time, some of the ink inside the reservoirs 206 is ,one as shown in FIG. 2B. Hence, the degree of vacuum inside the reservoirs 206 increases and the reservoirs contract. The pressure inside the ink reservoirs 206 remains below atmospheric pressure due to the presence of a restorative force provided by the deformation of the spring plates 212.

However, if the negative pressure inside the ink reservoirs 206 is too large, or in other words, if the difference in pressure between inside and outside is great atmospheric pressure may prevent ink from exiting through the nozzles during printing. Hence, negative pressure inside the ink reservoirs 206 must be carefully controlled so that ink can flow smoothly throughout the working life of the cartridge. Since the restorative force generated by the spring plates 212 is little affected by deformation the negative pressures inside the respective ink reservoirs 206 can be maintained within defined limits throughout the working life. Hence, the difficulties in ejecting ink from the nozzle during a printing operation are avoided. In other words the ink does not leak from the ink reservoir when the print head is not working but can still get out from the ink reservoirs during a normal printing operation.

Figure 2C:
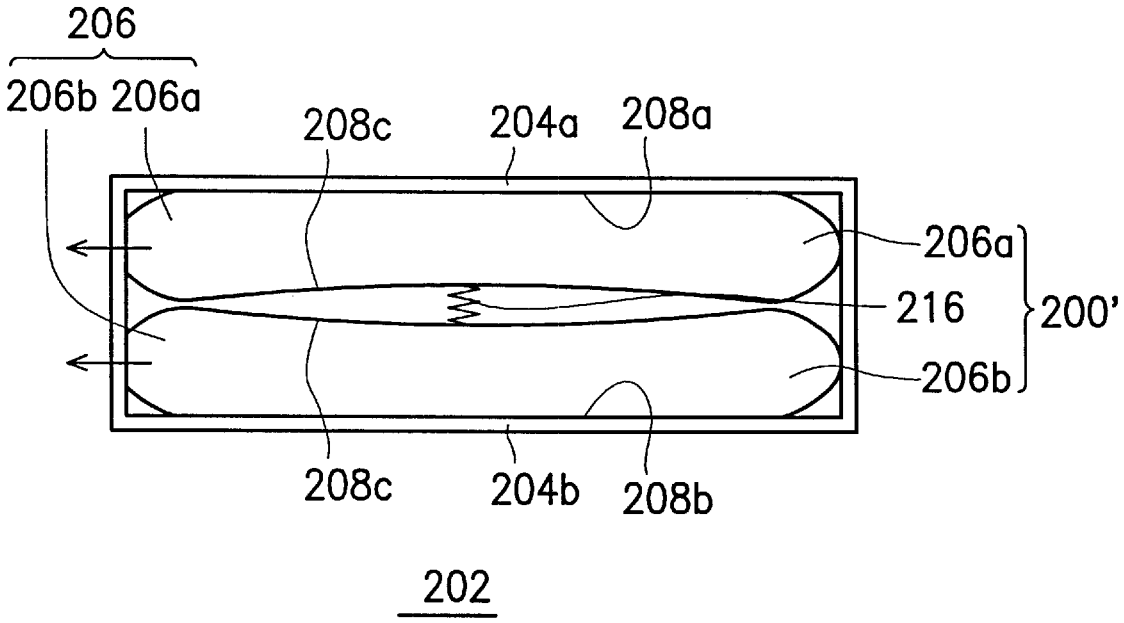
FIG. 2C is a schematic cross-sectional view showing an alternative pressure control device inside an inkjet cartridge also according to the first embodiment of this invention when the ink reservoirs are full.
Figure 2D:
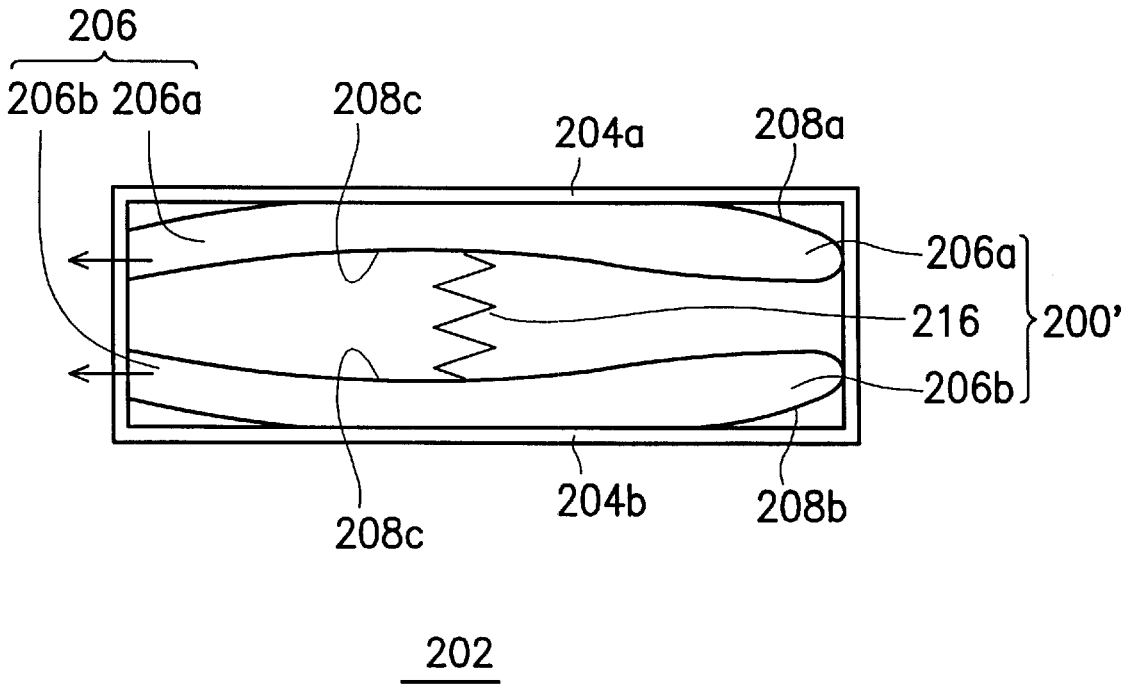
FIG. 2D is a schematic cross-sectional view showing the alternative pressure control device inside an inkjet cartridge also according to the first embodiment of this invention when the ink reservoirs are rather empty.

FIG. 2C is a schematic cross-sectional view showing an alternative pressure control device inside an inkjet cartridge also according to the first embodiment of this invention when the ink reservoirs are full. FIG. 2D is a schematic cross-sectional view showing the alternative pressure control device inside an inkjet cartridge also according to the first embodiment of this invention when the ink reservoirs are rather empty. FIGS. 2C and 2D are cross-sectional views of a cartridge body, very similar to the cartridge body 102, along a plane perpendicular to the viewing direction 108 in FIG. 1. Since FIGS. 2C and 2D are very similar to FIGS. 2A and 2B, identical elements are labeled identically. In this alternative arrangement the spring plates 212 are replaced by springs 216. The ends of the springs 216 are attached to the side faces 208*c* of neighboring ink reservoirs 206 near the central area of the cartridge. The springs 216 serve a similar function as the spring plate 212. In addition the springs 216 can be linear or non-linear springs.

When the inkjet cartridge is in use during printing, ink inside the ink reservoir gradually reduces. To maintain a constant back-pressure inside the ink reservoir throughout its working life, especially when most of the ink has been used, a flat plate can be installed on one side of the spring means. The spring plate or spring is attached directly to the flat plate instead of the ink reservoir, and so a uniform pressure is exerted on the ink reservoir. Furthermore, the ink reservoirs can be completely compressed with the spring plates, so all the ink inside the reservoir can be fully used.

Figure 3A:
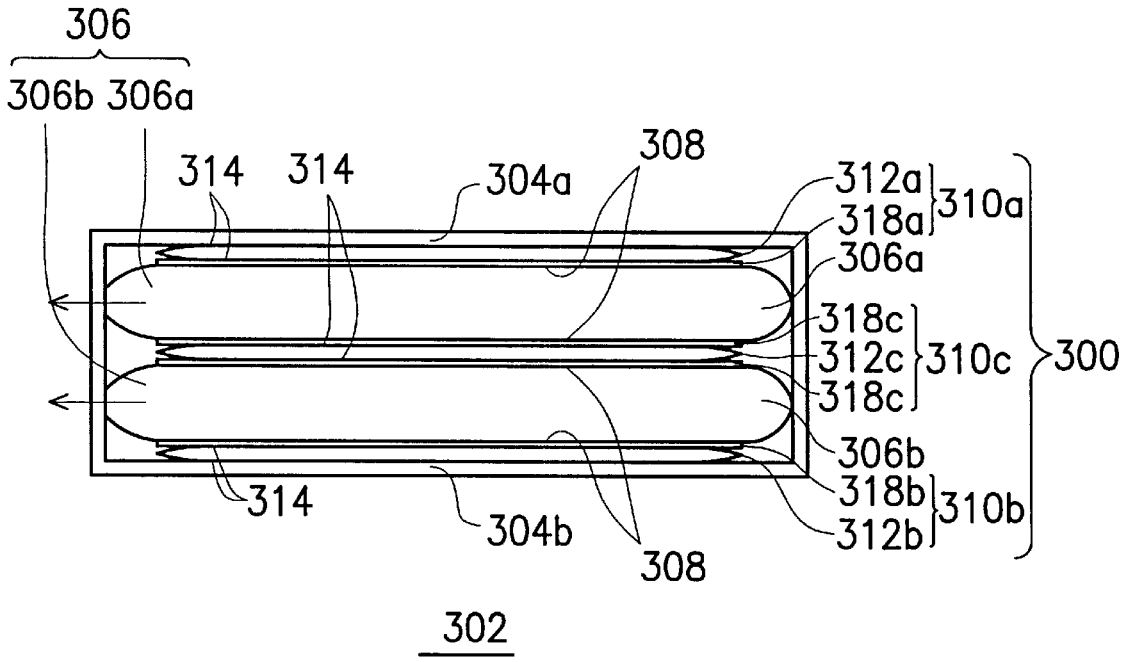
FIG. 3A is a schematic cross-sectional view showing the pressure control device inside an inkjet cartridge according to a second embodiment of this invention when the ink reservoirs are full.
Figure 3B:
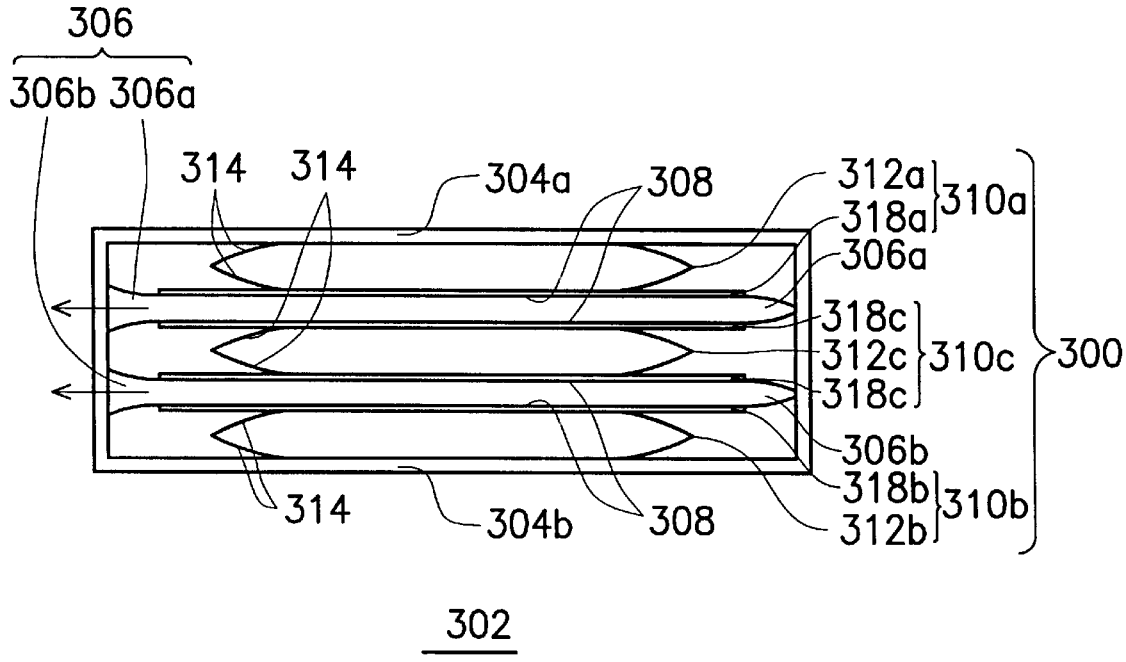
FIG. 3B is a schematic cross-sectional view showing the pressure control device inside an inkjet cartridge according to the second embodiment of this invention when the ink reservoirs are rather empty.

FIG. 3A is a schematic cross-sectional view showing the pressure control device inside an inkjet cartridge according to a second embodiment of this invention when the ink reservoirs are full. FIG. 3B is a schematic cross-sectional view showing the pressure control device inside an inkjet cartridge according to the second embodiment of this invention when the ink reservoirs are rather empty. The second embodiment is very similar to the first embodiment. In fact, FIGS. 3A and 3B are cross-sectional views of a cartridge body, very similar to the cartridge body 102 along a plane perpendicular to the viewing direction 108 in FIG. 1. The arrows in FIGS. 3A and 3B show the direction in which ink flows from the reservoirs 206*a* and 206*b* to the cartridge nose section (label 104 in FIG. 1).

As shown in FIG. 3A, the ink reservoirs 306 inside the cartridge body 302 are almost completely filled so that only a slight back-pressure is established. The pressure regulator 300 includes traction spring, means (130*a*, 310*b* and 310*c*) and ink reservoirs (306*a* and 306*b*). The cartridge body 302 has a first sidewall 304*a* and a second sidewall 304*b* that are parallel to each other. A plurality of reservoirs 306 are fitted inside the cartridge body 302 that also runs parallel to the first sidewall 304*a* and the second sidewall 304*b*, respectively. Each ink reservoir 306 has at least one side face 308 formed using flexible non-elastic material. The flexible non-elastic material includes aluminum foil and plastic sheet. The first ink reservoir 306*a* is attached to the first sidewall 304*a* while the second ink reservoir 306*b* attached to the second sidewall 304*b*.

The first traction spring means 310*a* is between the first sidewall 304*a* and the first reservoir 306*a*; the second traction spring means 310*b* is between the second sidewall 304*b* and the second reservoir 306*b*; and the third traction spring means 310*c* is between the two reservoirs 306*a* and 306*b*. The first spring means 310*a* includes a first spring plate assembly 312*a* and a first pressure plate 318*a*. The first spring plate assembly 312*a* is comprised of two spring plates with their front ends and their back ends bonded together. One side of the spring plate assembly 312*a* is attached to the first sidewall 304*a*. The first pressure plate 318*a* is between the first spring plate assembly 312*a* and the first reservoir 306*a*. One surface of the pressure plate 318*a* is attached to a spring plate of the spring plate assembly 312*a* while the other surface is attached to a side face of the first reservoir 306*a*.

The second traction spring means 310*b* is structurally identical to the first traction spring means 310*a*. The second traction spring means includes a second spring plate assembly 312*b* and a second pressure plate 318*b*. The second spring plate assembly 312*b* is in contact with the second sidewall 304*b*. The second pressure plate 318*b* is between the second spring plate assembly 312*b* and the second reservoir 306*b*. One surface of the second pressure plate 318*b* is attached to a spring plate of the second spring plate assembly 312*b* while the other surface is attached to a side face of the second reservoir 306*b*.

The third traction spring means 310*c* includes a third spring plate assembly 312*c* and a pair of pressure plates 308*c*. The pair of pressure plates 318*c* is parallel to the reservoirs 306*a* and 306*b*, respectively. Each pressure plate 318*c* is attached to one side face of the reservoirs 306. The third spring plate assembly 312*c* is comprised of two spring, plates 314 with their front ends and their back ends bonded together. Each spring plate 314 is in contact with the central area of a pressure plate 318*c*. Material for forming the spring plates 314*c* includes metals, plastic, bamboo, or wood. In addition springs can be used instead of the spring plate assemblies 312*a*, 312*b* an d 312*c*.

The pressure regulator 300 in this second embodiment of the invention operates in a similar manner as in the first embodiment. The main difference lies in their structures. In this embodiment, a first traction spring means 310*a* is mounted between the first sidewall 304*a* and the first reservoir 306*a* while a second traction spring means 310*b* is mounted between the second sidewall 304*b* and the s econd reservoir 306*b*. In addition, a third traction spring means 310*c* is mounted between the two reservoirs 306*a* and 306*b*. Furthermore, each of the traction spring means 310*a* and 310*b* has a pressure plate while the traction spring means 310*c* has two additional pressure plates attached.

As shown in FIG. 3B, after the cartridge has been in use for some time, most of the ink inside the reservoirs 306 is gone as shown in FIG. 3B. Hence the degree of vacuum inside the reservoirs 206 will increase and the reservoirs 306 will contract. Through the interaction between various traction spring means (312*a*, 312*b* and 312*c*) and reservoirs 306*a* and 306*b* inside the pressure regulator 300, a uniform pressure is exerted on the side faces 308 of the reservoirs 306*a* and 306*b*. Even when most of the ink inside the reservoirs 306 is gone, a constant back-pressure can still be maintained. Consequently, all the ink inside a reservoir can be fully used because large back-pressure is avoided.

Figure 3C:
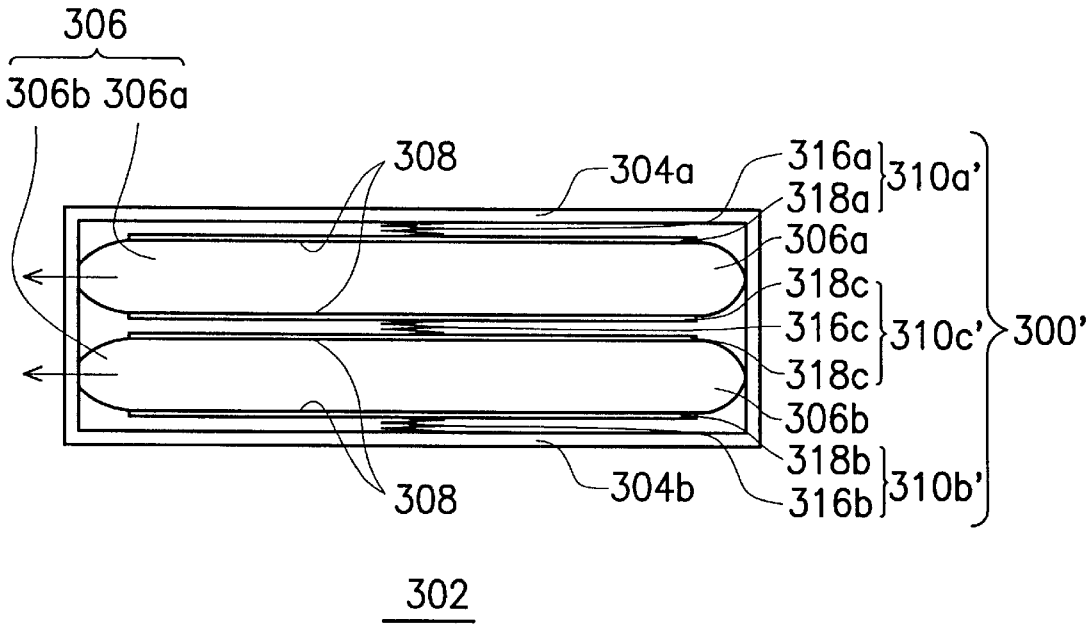
FIG. 3C is a schematic cross-sectional view showing an alternative pressure control device inside an inkjet cartridge also according to the second embodiment of this invention when the ink reservoirs are full.
Figure 3D:
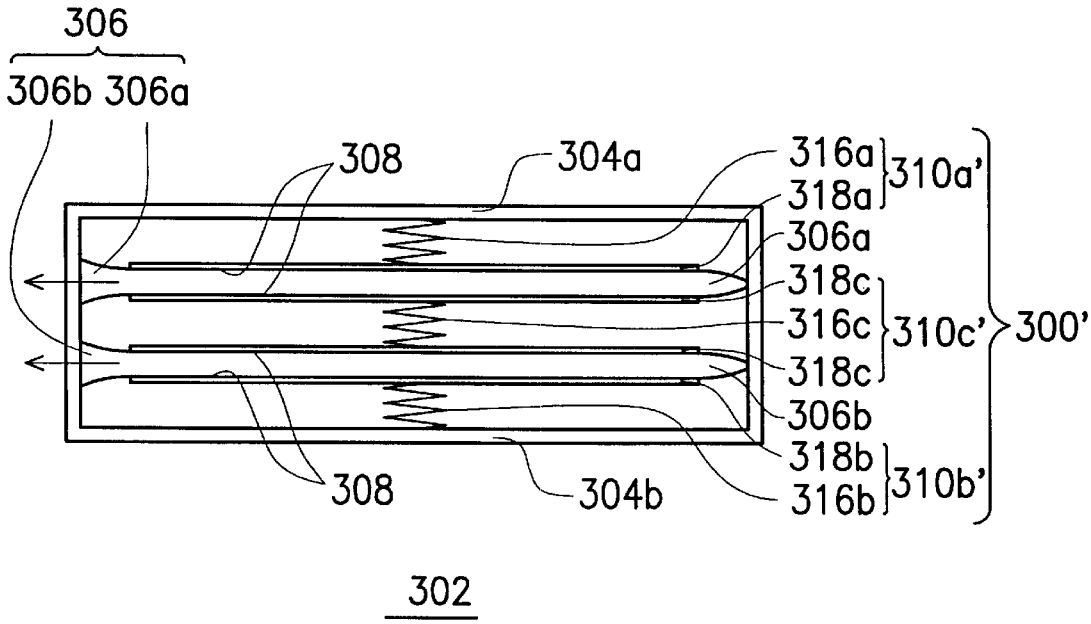
FIG. 3D is a schematic cross-sectional view showing the alternative pressure control device inside an inkjet cartridge also according to the second embodiment of this invention when the ink reservoirs are rather empty.

FIG. 3C is a schematic cross-sectional view showing an alternative pressure control device inside an inkjet cartridge also according to the second embodiment of this invention when the ink reservoirs are full. FIG. 3D is a schematic cross-sectional view showing the alternative pressure control device inside an inkjet cartridge also according to the second embodiment of this invention when the ink reservoirs are rather empty. FIGS. 3C and 3D are cross-sectional views of a cartridge body very similar to the cartridge body 102 along a plane perpendicular to the viewing direction 108 in FIG. 1. Since FIGS. 3C and 3D are very similar to FIGS. 3A and 3B, identical elements are labeled identically. In this alternative arrangement, the spring plates are replaced by springs.

As shown in FIGS. 3C and 3D, a first spring 316*a* is inserted into the space between the first sidewall 304*a* and the first pressure plate 318*a*. The ends of the first spring 316*a* are attached to the central section of the first sidewall 304*a* and the first pressure plate 318*a*, respectively. Similarly, a second spring 316*b* is inserted into the space between the second sidewall 304*b* and the second pressure plate 318*b*.

The ends of the second spring 316*b* are attached to the central section of the second sidewall 304*b*and the second pressure plate 318*b*, respectively. A third spring 316*c* is inserted into the space between the neighboring reservoirs 306*a* and 306*b*. The ends of the third spring 316*c* are attached to the central section of two similar pressure plates 318*c*. The springs 316*a*, 316*b* and 316*c* within various spring means (310*a*', 310*b*' and 310*c*') have functions identical to the aforementioned spring plates 314. In addition, the springs (316*a*, 316*b* and 316*c*) can be linear or non-linear springs as in the first embodiment of this invention.

In the aforementioned embodiments, two ink reservoirs are enclosed in the cartridge body. However, the pressure regulator of this invention can also be applied to a cartridge having two or more reservoirs. Since a traction spring means such as a spring is inserted between every pair of neighboring reservoirs, back-pressure inside each of the reservoir will be identical. Consequently, minor deviation of the dimensions of the traction spring means can be tolerated. Hence, the traction spring means can have a larger manufacturing tolerance than other conventional internal spring systems.

In addition, the spring plates used in the first embodiment can be replaced by other types of linear or non-linear springs. The ink reservoir preferably has a width smaller than 18 mm so that the back-pressure variation inside the ink reservoir is always contained within acceptable limits throughout the cartridge's working life.

In this invention, the spring plates or springs together with the pressure plates that constitute the traction spring means are all installed outside the reservoirs. Since these artifacts are not in contact with any ink, there is no need to worry about possible chemical reaction with ink or cleanliness of these artifacts. Hence, materials such as metal, plastic, bamboo or wood can all be used to form the spring plates and the pressure plates.

In summary, the pressure regulator of this invention is formed by assembling a set of springs or a set of spring plate assemblies, pressure plates and reservoirs together inside an inkjet cartridge. The number of necessary components is relative small and easy to assemble. Besides the prevention of ink from leaking from the cartridge, the pressure regulator permits printing to carry on until the last few drops of ink inside the reservoir are also used. In brief, the characteristics of this invention includes:

1. Since the traction spring means are installed outside the reservoir, there are fewer concerns regarding the type of material and the cleanliness of the material forming the traction spring means.

2. Using a set of springs or spring plates together with pressure plates, the pressure regulator permits the entire package of ink inside the reservoir to be fully used.

3. All the reservoirs inside the same cartridge body have identical back-pressure.

4. A larger deviation in manufacturing dimensions of the traction spring means can be tolerated.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pressure control device for regulating the ink pressure inside an ink box, wherein the ink box contains a first sidewall and a second sidewall that are parallel to each other, the pressure control device comprising:

a plurality of flexible ink reservoirs parallel to the first sidewall and the second sidewall of the ink box, wherein the ink reservoirs can at least be subdivided into a first ink reservoir and a second ink reservoir with one side of the first ink reservoir attached to the first sidewall and one side of the second reservoir attached to the second sidewall; and at least one traction spring means inside the ink box, wherein the traction spring means is attached to opposing sides of neighboring reservoirs.

2. The device of claim 1, wherein the traction spring means is composed of two spring plates with their front and back end bonded together to form a traction spring-plate assembly and the traction spring plate assembly is parallel to the ink reservoirs such that each external surface of the traction spring plate assembly is attached to an ink reservoir.

3. The device of claim 2, wherein the material for forming the spring plates is selected from a group consisting of metal, plastic, bamboo, and wood.

4. The device of claim 1, wherein the traction spring means includes a traction spring with each end attached to a side face of one of two neighboring ink reservoirs.

5. A pressure control device for regulating the ink pressure inside an ink box, wherein the ink box contains a first sidewall and a second sidewall that are parallel to each other, the pressure control device comprising:

a plurality of flexible ink reservoirs parallel to the first sidewall and the second sidewall of the ink box, wherein the ink reservoirs can be subdivided into at least a first ink reservoir and a second ink reservoir with one side of the first ink reservoir laid next to the first sidewall and one side of the second ink reservoir laid next to the second sidewall; and a plurality of traction spring means inside the ink box, including:

a first traction spring means whose external surfaces are respectively coupled to the first ink reservoir and the first sidewall;

a second traction spring means whose external surfaces are respectively coupled to the second ink reservoir and the second sidewall; and at least a third traction spring means whose external surfaces are respectively coupled to opposing sides of neighboring ink reservoirs.

6. The device of claim 5, wherein each traction spring means is composed of two spring plates with their front and back end bonded together to form a traction spring-plate assembly, the traction spring plate assembly is parallel to the ink reservoirs such that the external surfaces of a first traction spring plate assembly are respectively attached to the first ink reservoir and the first sidewall, the external surfaces of a second traction spring plate assembly are respectively attached to the second ink reservoir and the second sidewall, and the external surfaces of additional traction spring plate assemblies arc respectively attached to the opposing sides of each pair of neighboring ink reservoirs.

7. The device of claim 6, wherein the material for forming the spring plates is selected from a group consisting of metal, plastic, bamboo, and wood.

8. The device of claim 5, wherein the traction spring means includes traction springs with ends of a first traction spring respectively attached to one side of the first reservoir and the first sidewall ends of a second traction spring respectively attached to one side of the second reservoir and the second sidewall, and ends of additional traction springs respectively attached to two opposing sides of each pair of neighboring ink reservoirs.

9. The device of claim 5, wherein the first traction spring means further includes:

a first pressure plate parallel to and between the first ink reservoir and the first sidewall such that one surface of the first pressure plate is attached to one side of the ink reservoir; and a first traction spring plate assembly parallel to and between the first pressure plate and the first sidewall such that the external surfaces of the first traction spring plate assembly are respectively attached to the first sidewall and the first pressure plate.

10. The device of claim 5, wherein the second traction spring means further includes:

a second pressure plate parallel to and between the second ink reservoir and the second sidewall such that one surface of the second pressure plate is attached to one side of the second reservoir; and a second traction spring plate assembly parallel to and between the second pressure plate and the second sidewall such that the external surfaces of the second traction spring plate assembly are respectively attached to the second sidewall and the second pressure plate.

11. The device of claim 5, wherein the third traction spring means further includes:

a pair of third pressure plates parallel to and between each neighboring pair of ink reservoirs such that one surface of each third pressure plate is attached to the side of a reservoir; and a third traction spring plate assembly parallel to and between the pair of third pressure plates such that the external surfaces of the third traction spring plate assembly are respectively attached to the pair of third pressure plates.

12. The device of claim 5, wherein the first traction spring means includes:

a first pressure plate parallel to and between the first ink reservoir and the first sidewall such that a first surface of the first pressure plate is attached to one side of the first ink reservoir; and a first traction spring whose ends are respectively attached to a second surface of the first pressure plate and the surface of the first sidewall.

13. The device of claim 5, wherein the second traction spring means includes:

a second pressure plate parallel to and between the second ink reservoir and the second sidewall such that a first surface of the second pressure plate is attached to one side of the second ink reservoir; and a second traction spring whose ends are respectively attached to a second surface of the second pressure plate and the surface of the second sidewall.

14. The device of claim 5, wherein the third traction spring means further includes:

a pair of third pressure plates parallel to and between each neighboring pair of ink reservoirs such that one surface of each third pressure plate is attached to the side of a reservoir; and a third traction spring means whose ends are respectively attached to opposing surfaces of a pair of neighboring third pressure plates.

15. An ink cartridge for an inkjet print head, comprising:

an ink box having a first sidewall and a second sidewall that arc parallel to each other;

a plurality of flexible ink reservoirs parallel to the first sidewall and the second sidewall of an ink box interior, wherein the ink reservoirs can at least be subdivided into at least a first ink reservoir and a second ink reservoir with one side of the first ink reservoir laid next to the first sidewall and one side of the second reservoir laid next to the second sidewall; and at least one traction spring means inside the ink box, wherein the traction spring means is attached to the opposing sides of neighboring reservoirs.

16. The ink cartridge of claim 15, wherein the traction spring means is composed of two spring plates with their front and back end bonded together to form a traction spring-plate assembly, wherein the traction spring plate assembly is parallel to the ink reservoirs such that each external surface of the traction spring plate assembly is attached to an ink reservoir.

17. The ink cartridge of claim 15, wherein the traction spring means includes a traction spring with each end respectively attached to a side face of one of two neighboring ink reservoirs.

18. The ink cartridge of claim 15, wherein the ink cartridge further comprising:

a first traction spring means whose external surfaces respectively touch the first reservoir and the first sidewall; and a second traction spring means whose external surfaces respectively touch the second ink reservoir and the second sidewall.

19. The ink cartridge of claim 18, wherein the first traction spring means further includes:

a first pressure plate parallel to and between the first ink reservoir and the first sidewall such that one surface of the first pressure plate is attached to one side of the first ink reservoir; and a first traction spring assembly between the first pressure plate and the first sidewall such that the external surfaces of the first traction spring assembly are respectively attached to the first sidewall and the first pressure plate.

20. The ink cartridge of claim 18, wherein the second traction spring means further includes:

a second pressure plate parallel to and between the second ink reservoir and the second sidewall such that one surface of the second pressure plate is attached to one side of the second ink reservoir; and a second traction spring assembly between the second pressure plate and the second sidewall such that the external surfaces of the second traction spring assembly are respectively attached to the second sidewall and the second pressure plate.

21. A pressure control device for regulating the ink pressure inside an ink box, wherein the ink box contains a first sidewall and a second sidewall that are parallel to each other, the pressure control device comprising:

a plurality of flexible ink reservoirs parallel to the first sidewall and the second sidewall of the ink box, wherein the ink reservoirs can at least be subdivided into a first ink reservoir and a second ink reservoir with one side of the first ink reservoir attached to the first sidewall and one side of the second reservoir attached to the second sidewall; and a plurality of traction springs respectively arranged between and attached to each pair of neighboring ink reservoirs and arranged between and attached to one ink reservoir and the adjacent first or second sidewall to generate a negative pressure within the ink reservoirs.

22. A pressure control device for regulating the ink pressure inside an ink box, wherein the ink box contains a first sidewall and a second sidewall that are parallel to each other, the pressure control device comprising:

a plurality of flexible ink reservoirs parallel to the first sidewall and the second sidewall of the ink box, wherein the ink reservoirs can be subdivided into at least a first ink reservoir and a second ink reservoir with one side of the first ink reservoir laid next to the first sidewall and one side of the second reservoir laid next to the second sidewall; and a plurality of traction spring plate assemblies formed by a pair of spring plates bonded together by two ends of the spring plates, the spring plate assemblies being respectively arranged between and attached to each pair of neighboring ink reservoirs and arranged between and attached to one ink reservoir and the adjacent first or second sidewall to generate a negative pressure within the ink reservoirs.

23. The device of claim 22, wherein the material for forming the spring plates is selected from a group consisting of metal, plastic, bamboo, and wood.

24. A pressure control device for regulating the ink pressure inside an ink box, wherein the ink box contains a first sidewall and a second sidewall that are parallel to each other, the pressure control device comprising:

a plurality of flexible ink reservoirs parallel to the first sidewall and the second sidewall of the ink box, wherein the ink reservoirs can be subdivided into at least a first ink reservoir and a second ink reservoir with one side of the first ink reservoir laid next to the first sidewall and one side of the second reservoir laid next to the second sidewall;

a plurality of pressure plates respectively attached to the ink reservoirs; and a plurality of traction springs that are respectively arranged between and attached to each pair of neighboring ink reservoirs via the pressure plates and arranged between and attached to one ink reservoir via one of the pressures plates and the adjacent first or second sidewall, to generate a negative pressure within the ink reservoirs.

25. An ink cartridge for an inkjet print head, comprising:

an ink box having a first sidewall and a second sidewall that are parallel to each other;

a plurality of flexible ink reservoirs parallel to the first sidewall and the second sidewall of an ink box interior, wherein the ink reservoirs can at least be subdivided into at least a first ink reservoir and a second ink reservoir with one side of the first ink reservoir laid next to the first sidewall and one side of the second reservoir laid next to the second sidewall; and a plurality of traction springs that are respectively arranged between and attached to each pair of neighboring ink reservoirs and arranged and attached to one ink reservoir and the adjacent first or second sidewall to generate a negative pressure within the ink reservoirs.

26. An ink cartridge for an inkjet print head, comprising:

an ink box having a first sidewall and a second sidewall that are parallel to each other;

a plurality of flexible ink reservoirs parallel to the first sidewall and the second sidewall of an ink box interior, wherein the ink reservoirs can at least be subdivided into at least a first ink reservoir and a second ink reservoir with one side of the first ink reservoir laid next to the first sidewall and one side of the second reservoir laid next to the second sidewall; and a plurality of traction spring plate assemblies formed by a pair of spring plates bonded together by two ends of the spring plates, the spring plate assemblies being respectively arranged between and attached to each pair of neighboring ink reservoirs and arranged between and attached to one ink reservoir and the adjacent first or second sidewall to generate a negative pressure within the ink reservoirs.

27. The device of claim 26, wherein the material for forming the spring plates is selected from a group consisting of metal, plastic, bamboo, and wood.

28. An ink cartridge for an inkjet print head, comprising:

an ink box having a first sidewall and a second sidewall that are parallel to each other;

a plurality of flexible ink reservoirs parallel to the first sidewall and the second sidewall of an ink box interior, wherein the ink reservoirs can at least be subdivided into at least a first ink reservoir and a second ink reservoir with one side of the first ink reservoir laid next to the first sidewall and one side of the second reservoir laid next to the second sidewall; and a plurality of pressure plates respectively attached to the ink reservoirs; and a plurality of traction springs that are respectively arranged between and attached to each pair of neighboring ink reservoirs via the pressure plates and arranged between and attached to one ink reservoir via one of the pressures plates and the adjacent first or second sidewall to generate a negative pressure within the ink reservoirs.

* * * * *